United States Patent [19]

Wünsch

[11] Patent Number: 4,502,314

[45] Date of Patent: Mar. 5, 1985

[54] AUTOMATIC BENDING MACHINE

[76] Inventor: Adolf Wünsch, Haus Nr. 210, 8959 Seeg-Ried, Fed. Rep. of Germany

[21] Appl. No.: 631,020

[22] Filed: Jul. 17, 1984

Related U.S. Application Data

[63] Continuation-in-part of Ser. No. 250,691, Apr. 3, 1981, abandoned.

[51] Int. Cl.[3] ..... B21D 7/00

[52] U.S. Cl. ..... 72/380; 72/384; 72/449

[58] Field of Search ..... 72/388, 387, 449, 455, 72/380, 384

[56] References Cited

U.S. PATENT DOCUMENTS

| | | | |
|---|---|---|---|
| 1,277,234 | 8/1918 | McKenna | 72/388 |
| 1,305,990 | 6/1919 | Barry | 72/388 |
| 2,762,416 | 9/1956 | Middleton | 72/388 |
| 3,052,277 | 9/1962 | Stegmann | 72/380 |
| 4,052,875 | 10/1977 | Sakamoto | 72/387 |

*Primary Examiner*—Gene P. Crosby

*Attorney, Agent, or Firm*—Kuhn, Muller and Bazerman

[57] ABSTRACT

In an automatic bending machine, a box-like housing is provided in which a central driving wheel is mounted for reciprocating a plurality of slide units fastened at the front wall of the housing. The front wall is a front plate which together with the slide units can be easily removed from the housing and replaced by another one the slide units of which having been set up before at another place. A plurality of interchangeable front plates can be set up with slide units and tools. Each of the front plates is provided for a work piece of predetermined form. The front plates not in use can easily be stored for a replated use.

5 Claims, 3 Drawing Figures

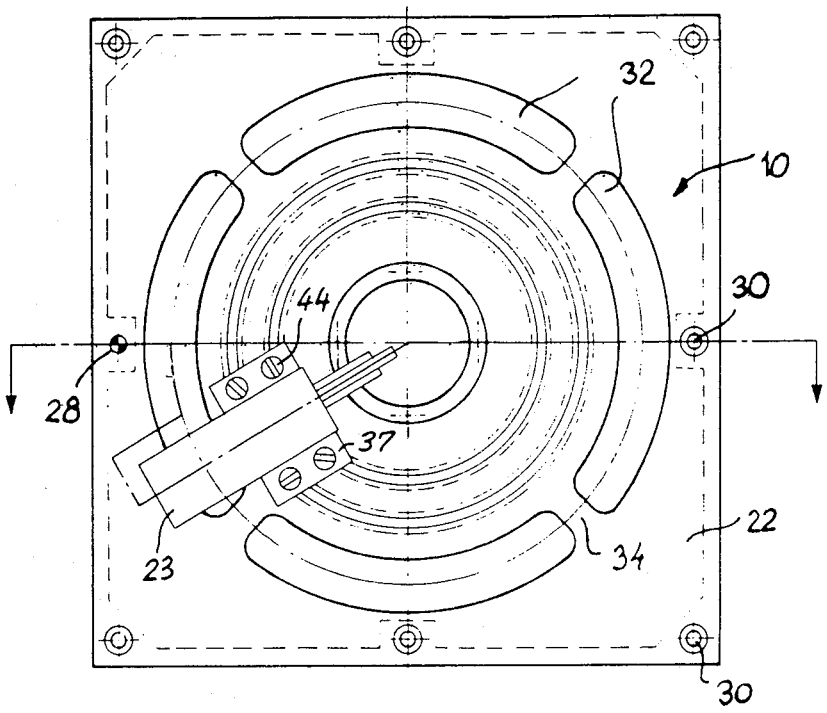
FIG.1
FIG.2
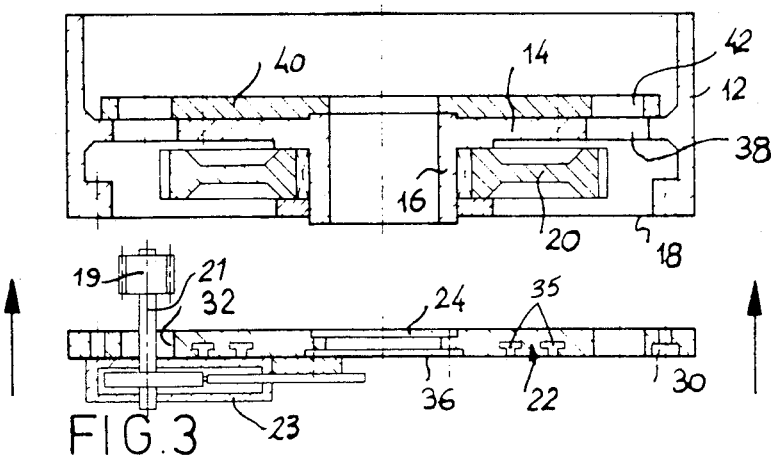
FIG.3

AUTOMATIC BENDING MACHINE

This application is a continuation-in-part of Application Ser. No. 250,691, filed Apr. 3, 1981, now abandoned.

BACKGROUND OF THE INVENTION

The present invention relates to an automatic bending machine for the production of multi-form work pieces. The bending machine is used in an installation comprising a draw-in system for a band or wire stock, a punching machine and at least one bending machine, whereby all said units are mounted on a common table and are drivingly connected with a common main drive. The set up time for the bending machine is great and during this period the installation is not in use. Therefore, it has been proposed in my pending application to construct the bending machine as a removable unit which as a whole can be interchanged by another unit which in a preceding period has been set up. However the whole bending machine comprising a heavy housing, a large toothed central driving wheel within the housing and driving connections provides high economical value which is lost during the setting-up periods. Problems exist with respect to the transportation of the heavy machine as well as with aligning and drivingly connecting it with the main drive of the installation.

SUMMARY OF THE INVENTION

Therefore, it is one object of the invention to provide a bending machine which can be reset at lower cost.

A further object is the provision of a bending machine in which only a part of the machine is involved in the resetting procedures.

One further object is the provision of a bending machine in which the slide units are finally assembled for a given work piece in an inexpensive manner and stored at a depository for later use.

A further object is the separation of the housing of the bending machine and the use only a part of this housing for resetting purposes while leaving the rest of the housing in the installation so as to maintain the driving connection of the central wheel and the main drive.

It is still a further object of the invention to provide a removable front plate at the housing carrying a plurality of slide units; the front plate being easily interchangeable with another use.

Also one object is to provide a bending machine having interchangeable front plates to provide a housing having open ends and an intermediate partition wall between which and the front plate the central driving wheel is supported whereby the housing is designed to removably fasten at the rearward side of the partition wall a second plate at least substantially corresponding to the front plate and also carrying slide units.

One further object is the provision of a bending machine in which the means for arranging the slide units, which are removed for resetting, have low weight.

These and other objects, features and advantages will become apparent from the following description and the claims.

BRIEF DESCRIPTION OF THE DRAWINGS

FIG. 1 shows a bottom view of a front plate of a horizontal bending machine box, FIG. 2 shows a cross-section of the bending machine box and FIG. 3 shows a cross-section of the front plate along line III—III of FIG. 1.

DESCRIPTION OF THE PREFERRED EMBODIMENT

The bending machine 10 comprises a rectangular housing 12 consisting of an open ended box of four walls. The housing is open at both ends and is provided with a partition wall 14 integrally formed with a hollow hub 16 which projects slightly beyond the front face 18 of the housing. A front chamber and a rearward chamber are formed within the housing 12 separated from one another by the partition wall 14 which extends in parallel relationship with the front plate 22. The partition wall 14 is integrally formed with the housing. A central driving gear wheel 20 is supported on the hub 16 by a ball bearing. The toothed outer circumference of the wheel 20 serves to drive pinions 19 fastened at driving shafts 21 of a plurality of slide units one of which is shown in FIGS. 1 and 3.

A removable front plate 22, which has the same peripheral configuration as the front face of the housing can be fastened to the front face 18 of the housing 12. The removable front plate 22 has a central opening provided with a rearward annular recess 24 and a forward annular recess 36. The hub 16 is snuggly fitted in the recess 24 and abuts against the annular face when the front plate 22 contacts the front face 18 of the housing. The front plate 22 is thereby centered at the housing and need only be slightly turned about its axis to align a bore 28 at one edge of the front plate with a corresponding bore in the wall of the housing 12 so that a set pin can be inserted. Further, holes 30 are provided at the peripheral edges of the front plate and these holes 30 are aligned with thread holes in the walls of the housing so that the front plate can easily be screwed to the housing.

Holding units, or slide pieces 37 which have a width the same as the opening width of concentric circular recesses 35 in front plate 22, but a slightly greater length so that they can be moved by 90° in the holding position in the circular recesses, are inserted in the circular recesses 35 which have a T-shaped cross-section. These holding pieces are secured by bolts 44, as shown in FIG. 1, pass through the side flanges of the bending units 23 and engage with the threads in the holes of the holding units.

The front plate 22 is provided with long curved slots 32 extending along a circular arc of slightly less than 90°. Between each pair of slots a small bridge 34 is formed. Driving shafts of the slide units fastened at the front plate project through these slots 32 and pinions at the ends of the driving shafts are brought in engagement with the central wheel 20 when the front plate is mounted. The curved slots 32 are arranged with an equal radial distance from the central opening of plate 22.

The partition wall 14 in connection with the hollow hub 16 provides a rigid bracing allowing a thin-walled housing.

The additional central support of the front plate by the hub 16 is very important in allowing a thin-walled front plate.

The partition wall 14 of the housing is provided with a slot arrangement 38 substantially equal with that of the front plate 22. Although in FIG. 2 the slots 38 of the partition wall 14 are shown slightly broader than those of the front plate, they can be made of equal width. A mounting plate 40 is removably fastened at the backside of the partition wall. This mounting plate 40 is preassembled with slide units at the backside of which and also is provided with a slot arrangement 42 which is identical with that of the front plate. The driving shafts therefore protrude through the aligned slots 42, 38 and the pinions of which engage with the central wheel 20. By this arrangement, many more slide units can be operated in one bending machine and driven by the common central wheel.

Because the mounting plate 40 is supported at its whole surface at the partition wall, it can be fastened by screws in a number of ways, for example, as shown in FIG. 2. However, one preferred embodiment consists in using a mounting plate 40 of the same size and configuration as the front plate 22 so that only one type of mounting plates carrying slide units is used. They are interchangeable. This requires that the rearward face of the partition wall be at least equal with the front face of the housing. Therefore, at least the inner circumference of the housing walls in the region rearward of the partition wall must be larger than the inner circumference in front of the partition wall.

I claim:

1. A rectangular box-like housing for a bending machine, the housing having a front wall with a front face, comprising a front plate removably fastened to the front face of the housing, a partition wall extending in parallel relationship with the front plate and being integrally formed with the housing, the partition wall separating the housing into a front chamber and a rearward chamber within said housing, an elongated central hollow hub integrally formed with said partition wall and extending axially through said front chamber, a central driving gear wheel mounted for rotation on said hollow hub within the front chamber, the hollow hub extending axially beyond the front face of the housing, the front plate having a central opening, the hollow hub projecting into said front plate adjacent the central opening, said hollow hub thereby acting as means for centering the front plate, the front plate having a plurality of openings comprising through-holes extended through the front plate and arranged at an equal radial distance from the central opening for the passage of driving shafts which are designed to drivingly engage with said central driving gear wheel.

2. A rectangular housing as claimed in claim 1, wherein the plurality of openings in the front plate comprise circular arc slots, and further comprising small radial bridges between the circular arc slots.

3. A rectangular housing as claimed in claim 1, wherein the front plate includes an annular recess with an annular radial face surrounding the central opening as the centering means for the hollow hub, and wherein the hollow hub axially abuts the annular radial face.

4. A rectangular housing as claimed in claim 1, further comprising a mounting plate removably fastened in the rearward chamber at the rearward side of the partition wall, the mounting plate having a central opening coaxially arranged with the central opening of the front plate, the mounting plate having through-holes which are radially arranged for axial alignment with the through holes of the front plate, and wherein the partition wall has corresponding openings as through-holes aligned with those of the mounting plate.

5. A rectangular housing as claimed in claim 1, wherein the housing includes thread holes in the front face, and wherein the front plate has the same peripheral shape as the housing, the front plate having holes at the edges thereof aligned respectively with thread holes in the front face of the housing.

* * * * *